US005542383A

United States Patent [19]

Clarke et al.

[11] Patent Number: 5,542,383

[45] Date of Patent: Aug. 6, 1996

[54] DUAL OUTPUT CAMSHAFT PHASE CONTROLLER

[75] Inventors: James R. Clarke; Roy E. Diehl, both of Northville, Mich.

[73] Assignee: Ford Motor Company, Dearborn, Mich.

[21] Appl. No.: 434,233

[22] Filed: May 4, 1995

[51] Int. Cl.[6] ..... F01L 1/344

[52] U.S. Cl. ..... 123/90.17; 123/90.31; 74/568 R; 464/2

[58] Field of Search ..... 123/90.15, 90.17, 123/90.31; 74/568 R; 464/1, 2, 160

[56] References Cited

U.S. PATENT DOCUMENTS

| | | | |
|---|---|---|---|
| 3,106,195 | 10/1963 | Hanley | 123/90.15 |
| 4,671,223 | 6/1987 | Asano et al. | 123/90.31 |
| 4,805,566 | 2/1989 | Ampferer | 123/90.15 |
| 4,974,560 | 12/1990 | King | 123/90.17 |
| 4,993,370 | 2/1991 | Hashiyama et al. | 123/90.17 |
| 4,996,955 | 3/1991 | Akasaka et al. | 123/90.17 |
| 5,117,784 | 6/1992 | Schechter et al. | 123/90.17 |
| 5,181,485 | 1/1993 | Hirose et al. | 123/90.17 |

*Primary Examiner*—Weilun Lo

*Attorney, Agent, or Firm*—Jerome R. Drouillard; Roger L. May

[57] ABSTRACT

A camshaft phase controller for an internal combustion engine controls separate intake and exhaust camshafts driven by the engine's crankshaft such that the angular phases of the camshafts may be varied by different amounts from a predetermined phase relationship with the crankshaft.

7 Claims, 3 Drawing Sheets

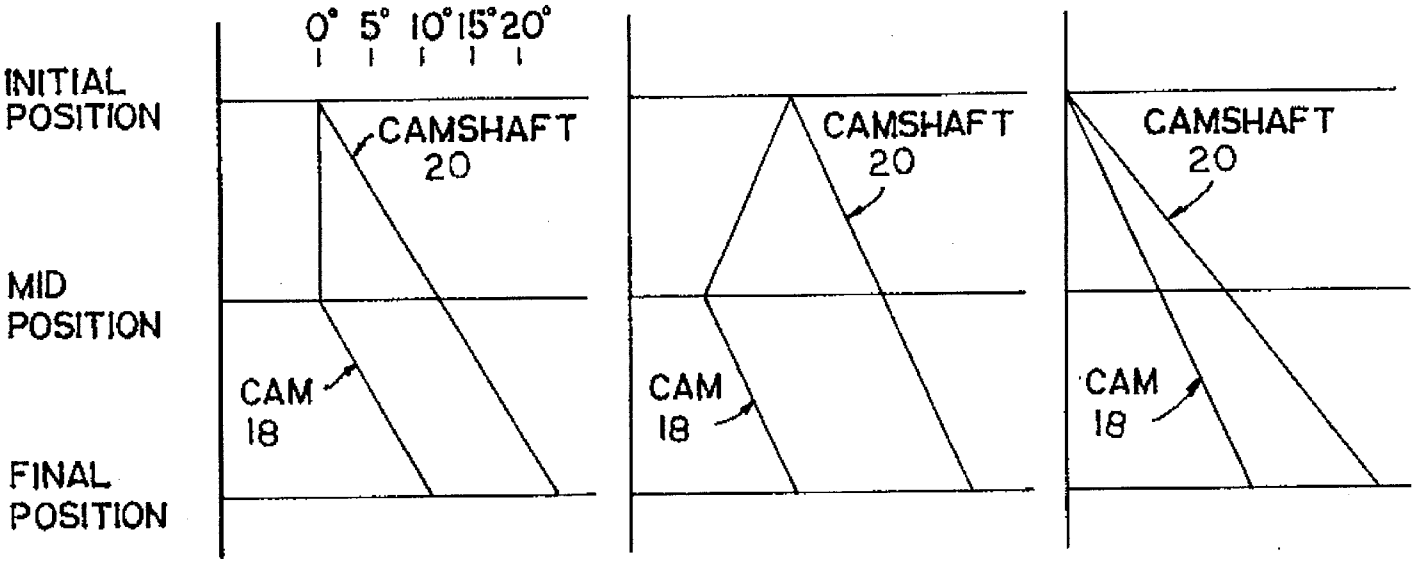
FIG.3
FIG.4
FIG.5
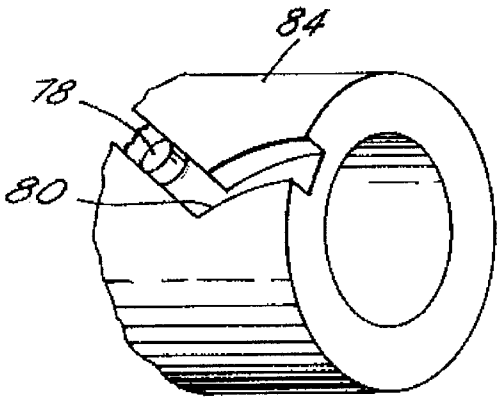
FIG.6

DUAL OUTPUT CAMSHAFT PHASE CONTROLLER

BACKGROUND OF THE INVENTION

FIELD OF THE INVENTION

The present invention relates to a camshaft phase controller for an internal combustion engine which may be used to obtain unequal phase changes of the intake and exhaust camshafts of an engine.

DISCLOSURE INFORMATION

Camshaft phase changers have been used for many years in internal combustion engines for the purpose of changing the phasing or timed relationship of one or more camshafts to the engine's crankshaft. Although it is known to change the phase of one or, as noted above, even two camshafts with respect to the crankshaft, it is not known to provide, with a single mechanism, the ability to change the phase relationship of both the exhaust and intake camshafts by different amounts and, more to the point, in different directions. The present invention offers the capability of controlling multiple camshafts, for a single cylinder bank, in both respects. Although it is known to use a splined gearset having a piston for changing the phase relationship between a single camshaft and a crankshaft, it is not known to vary the phase relationship of two camshafts with respect to each other, as well as to the crankshaft of the engine, through the use of a linearly actuatable device.

As used herein, the term "phase" or "phase change" means the rotational position of the particular portion of the valve operating system being referred to. For example, the phase of a camshaft refers to the camshaft's rotational position with respect to the crankshaft of the engine. In this respect, a phase change with a non-zero value means that the camshaft's position has been altered to either lead or lag its original operating position. Of course, a zero-value phase change means that the camshaft's position with respect to the crankshaft is unchanged.

SUMMARY OF THE INVENTION

A camshaft phase controller according to the present invention is intended to be used with an internal combustion engine having a crankshaft and poppet cylinder valves actuated by separate intake and exhaust camshafts driven by the crankshaft. A phase controller comprises an input member driven by the crankshaft, a drive hub adapted to be fixed to a first camshaft, an output member mounted to the drive hub so as to permit relative rotation between the output member, the input member, and the drive hub, with the output member being adapted to drive a second camshaft. An actuator interposed between the input member, the drive hub and the output member controllably changes the rotational position of the drive hub with respect to the input member, as well as the rotational position of the output member with respect to the drive hub. A mechanism according to the present invention is capable of producing unequal phase changes between the drive hub and the crankshaft and between the output member and the crankshaft. This means that the phase change between a first camshaft and the crankshaft is not equal to the phase change between a second camshaft and the crankshaft. The input member is preferably driven by either a flexible inextensible member, such as a chain or belt, extending between the crankshaft and the sprocket or, alternatively, by a gear train extending between the crankshaft and the input member. The output member of a phase controller according to the present invention may comprise either a sprocket for driving a second camshaft through a chain or cogged belt, or a gear for driving a second camshaft through a gear train.

According to yet another aspect of the present invention, a drive hub preferably comprises a generally annular housing adapted to receive portions of the input member, a first camshaft, and an output member. The controlled changing of phases is accomplished by an actuator, including a piston slidably housed within the generally annular housing, with the piston having an outer cylinder with internal splines formed therein, and an inner cylinder having internal and external splines formed therein. The splines on the outer cylinder are operatively engaged with mating splines formed on the input member. The internal splines on the inner cylinder are operatively engaged with mating splines formed on a portion of the generally annular housing, which is adapted for non-rotatable engagement with a first camshaft. The external splines on the inner cylinder are operatively engaged with mating splines formed on the output member such that sliding motion of the piston with respect to the generally annular housing causes relative rotation between the input member, the annular housing, and the output member. This sliding motion, then, of the piston alters the phase relationship between the crankshaft and each of the intake and exhaust camshafts.

According to yet another aspect of the present invention, the actuator piston is positioned by pressurized fluid contained in a first chamber extending between one end of the piston and an external bulkhead of the generally annular housing, and a second chamber extending between the second end of the piston and an external bulkhead of the housing. The pressurized fluid may comprise engine lubricating oil which is furnished to the phase controller through at least two bearing towers upon which the first camshaft is mounted, with one of the bearing towers furnishing pressurized oil to the first chamber and another tower furnishing pressurized oil to a second chamber so as to allow the piston to be biased in a plurality of positions.

It is thus seen that the present invention may be an integral part of a popper valve operating system for an internal combustion engine having intake and exhaust camshafts driven by the engine's crankshaft. The present invention is advantageous because it allows the intake and exhaust camshaft phasing to be performed in unequal magnitudes and unequal directions, which is beneficial for controlling emissions, while producing superior fuel economy results. For example, it is possible at idle to provide a minimum amount of overlap between the intake and exhaust events, so as to promote combustion stability, while increasing the amount of overlap at high engine speeds, so as to permit better breathing and higher specific output of the engine. These and other advantages will become apparent to the reader of this specification.

BRIEF DESCRIPTION OF THE DRAWINGS

FIGS. 3, 4, and 5 illustrate various camshaft phase relationships which may be produced with a system according to the present invention.

FIG. 6 further illustrates the embodiment of FIG. 2B.

DETAILED DESCRIPTION OF THE PREFERRED EMBODIMENTS

Figure 1:
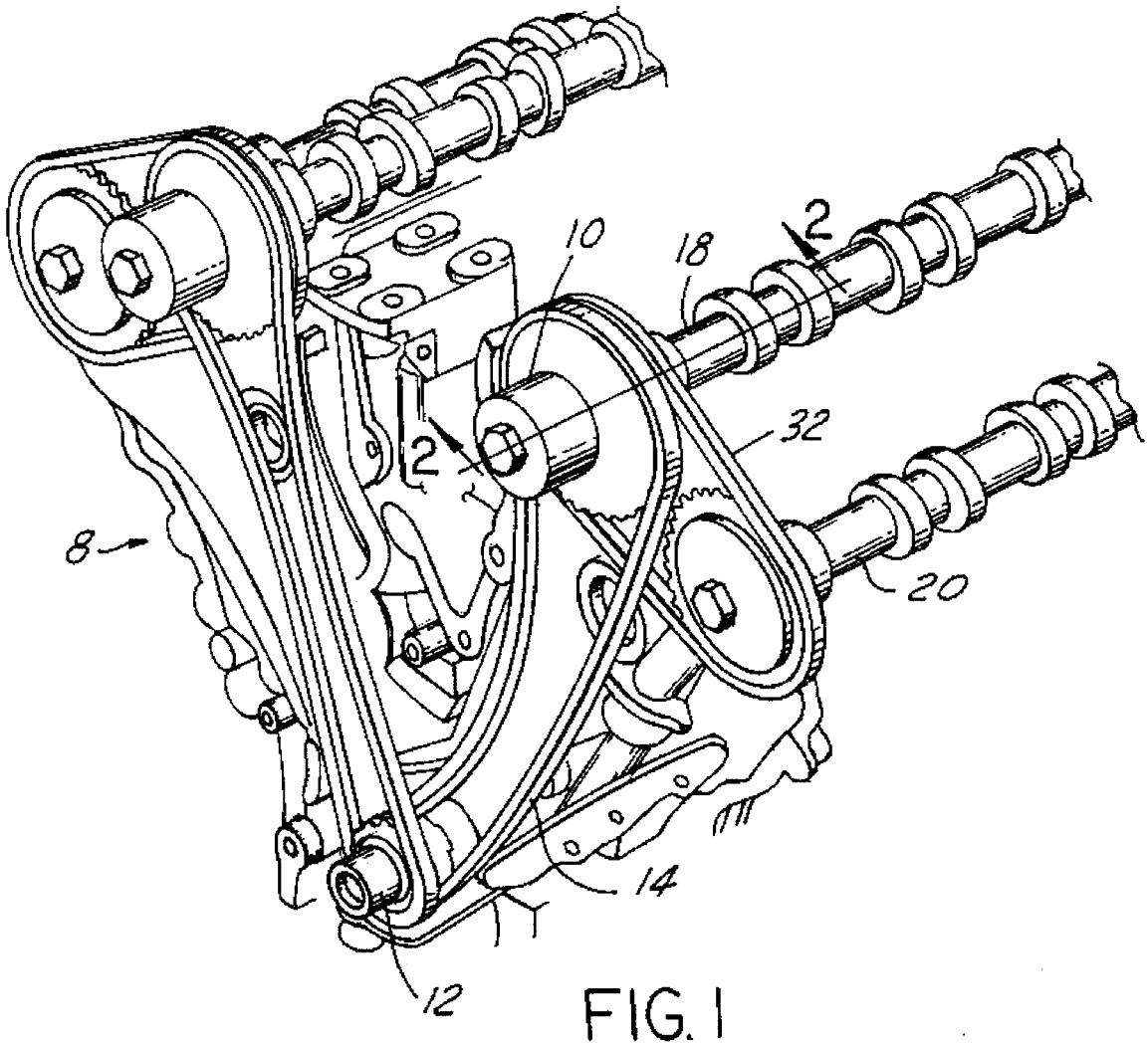
FIG. 1 is a perspective view of an engine having a valve operating system according to the present invention.

As shown in FIG. 1 engine 8 has camshaft phase controller 10 which is driven by crankshaft 12 via timing chain 14. Notice that timing chain 14 drives only camshaft phase controller 10, which in turn drives camshaft 18, as described below, which is the intake camshaft of engine 8 and which operates a number of intake popper valves (not shown). Exhaust camshaft 20 is driven by camshaft phase controller 10 via secondary timing chain 32. Those skilled in the art will appreciate in view of this disclosure that various types of cogged drivebelts and/or gearsets could be used for the purpose of operating an engine's poppet valves according to the present invention. Moreover, a system according to the present invention could be employed with not only V-block engines, but also inline engines and other types of engines using camshaft arrangements which may benefit from the controlled changing of camshaft phase angle.

Figure 2A:
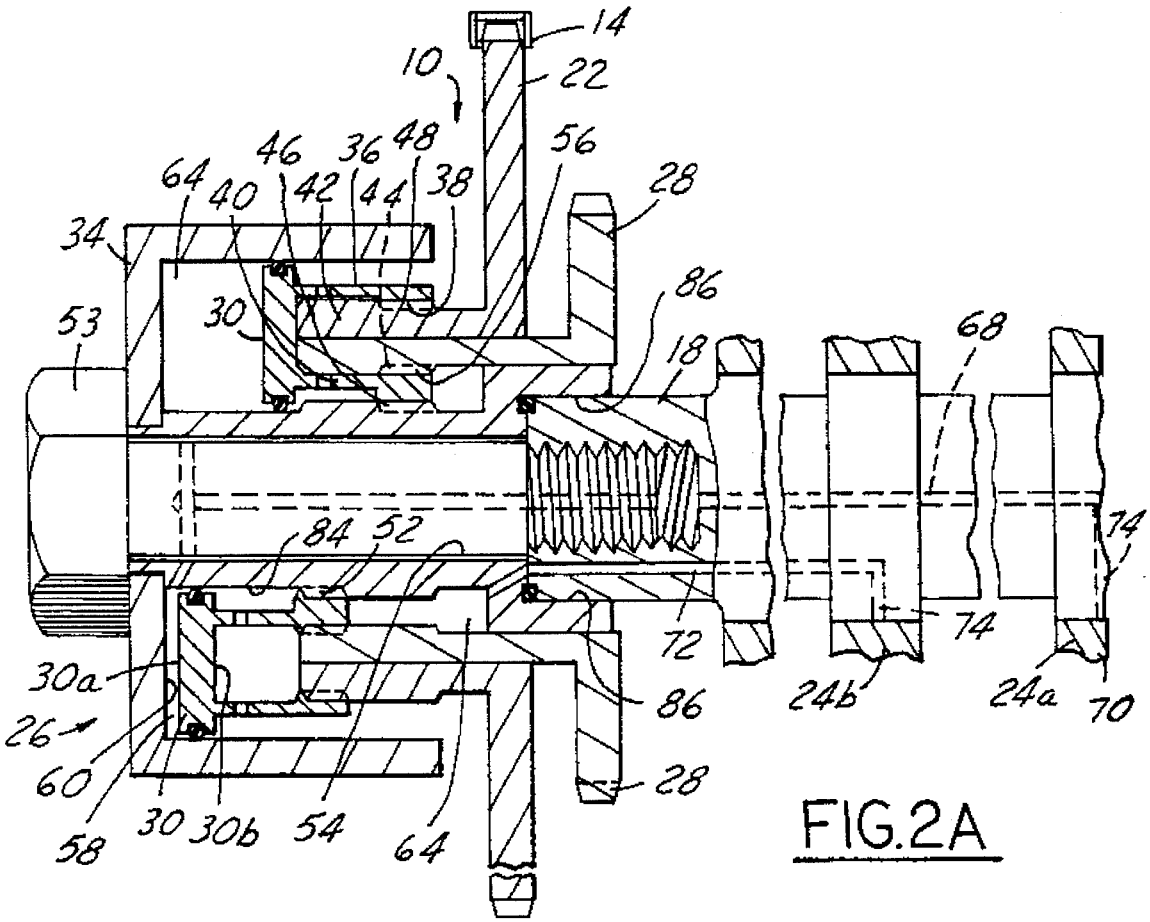
FIGS. 2A and 2B are sectional representations of a portion of a popper valve operating system according to the present invention, including a camshaft phase controller, which is taken along the line 2—2 of FIG. 1.

FIG. 2A illustrates certain details of a camshaft phase controller according to the present invention. Power is input to phase controller 10 by means of input member 22, which in this case comprises a chain sprocket which is driven by crankshaft 12 by means of chain 14. Torque is transmitted by input member 22 to the balance of camshaft phase controller 10 by means of a series of mating splines 48 formed on the external cylindrical surface of annular extension 42 of input member 22. Mating splines 48 mesh with internal splines 38 formed on outer cylinder 36 which comprises a portion of actuator piston 30. Splines 38 and 48 are formed helically such that as actuator piston 30 slides axially along its stroke, the helical twist of splines 38 and 48 will cause the phase relationship between input member 22 and actuator piston 30 to change. This change in rotational relationship is combined with a simultaneous change in phase between actuator piston 30 and generally annular housing 34, which is part of drive hub 26.

Generally annular housing 34 is adapted for non-rotatable engagement with camshaft 18, which in this case comprises the intake camshaft. Those skilled in the art will appreciate in view of this disclosure that a system according to the present invention could be utilized with camshaft phase controller 10 mounted upon either intake camshaft 18 or exhaust camshaft 20 according to the needs of a particular engine to which the present system is being applied.

Camshaft 18 is maintained in contact with generally annular housing 34 by means of bolt 53, which is threaded axially into camshaft 18 through central bore 54 formed in generally annular housing 34.

The sliding motion of piston 30 causes a phase change between generally annular housing 34 and piston 30 itself because internal splines 46, which are formed on inner cylinder 40 which comprises a portion of piston 30, mesh with mating splines 52 which are contained upon inner annulus 84 which is integral with generally annular housing 34. Thus, as piston 30 moves back and forth from its location adjacent input member 22 and output member 28 to the opposite end of generally annular housing 34 wherein piston 30 is adjacent external bulkhead 60 which is formed integrally with generally annular housing 34, the phase relationship between input member 22 and camshaft 18 will be changed. Of equal importance, however, the phase relationship between input member 22 and output member 28 will also be changed. This is accomplished by means of mating splines 56, which are formed on an inner cylindrical surface of output member 28, and which mesh and mate with external splines 44 formed on the external surface of inner cylinder 40, which as described above, is an integral portion of piston 30. Thus, as piston 30 moves back and forth within generally annular housing 34, the phase relationships between input member 22, output member 28, and camshaft 18 all change. Because the phase relationship between output member 28 and exhaust camshaft 20 is invariant, camshaft 20 will have precisely the same phase relationship with camshaft 18 and crankshaft 12, as does output member 28.

Figure 2B:
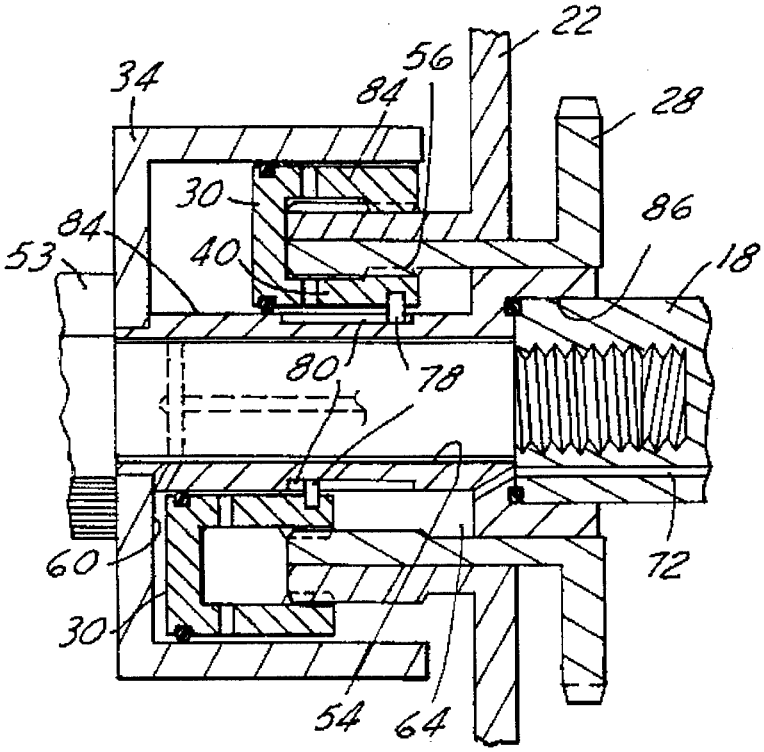

FIGS. 3, 4, and 5 illustrate merely three of the plurality of phase relationships possible with a camshaft phase controller according to the present invention. As shown in FIG. 3, with piston 30 in the initial position which is furthest from input member 22, exhaust camshaft 20 and intake camshaft 18 have an unshifted phase relationship with respect to the crankshaft 12. However, when piston 30 reaches the mid-position of its stroke, notice that exhaust camshaft 20 has achieved approximately a retard or advance—in this case, most probably a retard—of 10 crankshaft degrees. Note, too, that intake camshaft 18 is not retarded with piston 30 at mid-position. Accordingly, the amount of overlap between the intake and exhaust camshaft events will be reduced, thereby promoting smoother low speed operation of the engine. As piston 30 continues to its fully extended, final position adjacent input member 22, notice that the phase change of exhaust camshaft 20 continues unabated, whereas the phase of intake camshaft 18 begins changing with a similar slope. This change may be accomplished with a mechanism comprising a second embodiment according to the present invention, shown in FIGS. 2B and 6, wherein an internal drivepin is formed on the inner surface of cylinder 40 in lieu of internal splines 46. Pin 78 rides in mating groove 80 which is formed in the surface of inner annulus 84 of generally annular housing 34. Because mating groove 80 need not be straights but can describe a V-shape, as shown in FIG. 6, or other shapes, it is seen that the phase relationships of FIGS. 3 and 4 may be produced with the groove and pin arrangement of FIGS. 2B and 6.

With the phasing arrangement shown in FIG. 4, the phase changes of intake camshaft 18 and exhaust camshaft 20 are in opposite directions initially and thereafter in the same direction. In general, the phase relationships according to FIG. 3 are such that exhaust camshaft 20 has a phase change with a non-zero value, at all positions of piston 30, other than the position at which piston 30 is resting against bulkhead 60, with intake camshaft 18 having a phase change which is initially zero and then non-zero and in the same direction as the phase change of the first camshaft, which in this case is intake camshaft 18.

In another vein, according to FIG. 5 the phase changes of intake camshaft 18 and exhaust camshaft 20 are in the same direction with respect to crankshaft 12, with the phase change of intake camshaft 18 having a lesser absolute value than the phase change of exhaust camshaft 20 for any particular operational position of actuator piston 30.

High pressure oil is supplied to phase controller 10 via camshaft bearing towers 24*a* and 24*b*. Oil entering camshaft 18 through tower 24*a* first moves through radial passage 74 and then axially along camshaft 18 through central oil passage 68, and after passing through other passages enters first chamber 58 wherein the oil is able to push actuator piston 30 in the direction toward input member 22. Actuator piston 30 is returned from the extreme position adjacent input member 22 by means of high pressure oil entering camshaft 18 through bearing tower 24*b* via oil passage 70 formed in tower 24*b*. Those skilled in the art will appreciate in view of this disclosure that an actuator piston according to the present invention may be positioned at any desired location along its stroke with the aid of a linear position sensing device such as a linear variable differential transformer, or through the use of other suitable analog or digital devices known in the engine control art.

While the invention has been shown and described in its preferred embodiments, it will be clear to those skilled in the arts to which it pertains that many changes and modifications may be made thereto without departing from the scope of the invention. For example, a system according to the present invention could use other types of actuators, such as a lead screw driven by a torque motor, or yet other types of hydraulic or electronic or pneumatic actuators having the capability of precise linear positioning. Also, the present invention could be employed with a concentric camshaft arrangement in which the intake and exhaust camshafts for a bank of cylinders are mounted about a common axis, with one of the camshafts having a hollow shell to which lobes are rigidly attached, and a series of ports through which the lobes of an inner camshaft protrude, with the inner and outer camshafts being rotatable with respect to each other. Such an arrangement is shown in U.S. Pat. No. 5,253,546, which is incorporated by reference herein. Finally, the magnitudes and directions of camshaft phase changes may be selected from an almost infinite number of combinations according to the needs of any particular engine to which a system according to the present invention is being applied.

We claim:

1. A camshaft phase controller for an internal combustion engine having a crankshaft and poppet valves actuated by separate intake and exhaust camshafts driven by the crankshaft, with said phase controller comprising:

an input member driven by the crankshaft;

a drive hub adapted to be fixed to a first camshaft;

an output member mounted to said drive hub so as to permit relative rotation between the output member, the input member, and the drive hub, with said output member being adapted to drive a second camshaft;

an actuator interposed between said input member, said drive hub, and said output member, for controllably changing the rotational position of said drive hub with respect to said input member and the rotational position of said output member with respect to said drive hub, with said drive hub comprising a generally annular housing adapted to receive portions of said input member, said first camshaft, and said output member and with said actuator comprising a piston slidably housed within said generally annular housing, with said piston having an outer cylinder with internal splines formed therein, and an inner cylinder having internal and external splines formed therein, with said splines on said outer cylinder being operatively engaged with mating splines formed on said input member, and with said internal splines on said inner cylinder being operatively engaged with mating splines formed on a portion of the generally annular housing which is adapted for non-rotatable engagement with a first camshaft, and with said external splines on said inner cylinder being operatively engaged with mating splines formed on said output member, such that sliding motion of said piston with respect to the housing causes relative rotation between the input member, the annular housing and the output member.

2. A camshaft phase controller according to claim 1, wherein said input member comprises a sprocket driven by a flexible, inextensible member extending between said crankshaft and said sprocket.

3. A camshaft phase controller according to claim 1, wherein said output member comprises a sprocket.

4. A camshaft phase controller according to claim 1, wherein said piston is positioned by pressurized fluid contained in a first chamber extending between one end of the piston and an external bulkhead of said generally annular housing and a second chamber extending between a second end of the piston and an internal end of the housing.

5. A camshaft phase controller according to claim 1, wherein said pressurized fluid comprises engine lubricating oil which is furnished to said phase controller through at least two bearing towers upon which said first camshaft is mounted, with one of said bearing towers furnishing pressurized oil to the first chamber, and another of said towers furnishing pressurized oil to the second chamber, so as to allow the piston to be biased to a plurality of positions.

6. A camshaft phase controller according to claim 1, wherein said actuator comprises a piston slidably housed within said generally annular housing, with said piston having an outer cylinder with internal splines formed therein, and an inner cylinder having external splines and an internal drive pin formed therein, with said splines on said outer cylinder being operatively engaged with mating splines formed on said input member, and with said internal drive pin on said inner cylinder being operatively engaged with a mating groove formed on an inner annulus of said annular housing which is adapted for non-rotational engagement with a first camshaft, and with said external splines on said inner cylinder being operatively engaged with mating splines formed on said output member, such that sliding motion of said piston with respect to the housing causes relative rotation between the input member, a first camshaft, and the output member.

7. A valve operating system according to claim 1, wherein the phase change of said first camshaft and the phase change of the second camshaft are in opposite rotational directions from and initial position of the actuator to an intermediate position of the actuator, and thereafter said phase change is in the same direction.

* * * * *